US010261533B2

(12) United States Patent
Lu et al.

(10) Patent No.: US 10,261,533 B2
(45) Date of Patent: Apr. 16, 2019

(54) LOW DROPOUT REGULATOR (LDO) CIRCUIT

(71) Applicants: Semiconductor Manufacturing International (Beijing) Corporation, Beijing (CN); Semiconductor Manufacturing International (Shanghai) Corporation, Shanghai (CN)

(72) Inventors: Bin Lu, Shanghai (CN); Jun Wang, Shanghai (CN); Sen Liu, Shanghai (CN)

(73) Assignees: Semiconductor Manufacturing Intl. (BEIJING) Corp., Beijing (CN); Semiconductor Manufacturing Intl. (SHANGHAI) Corp., Shanghai (CN)

( * ) Notice: Subject to any disclaimer, the term of this patent is extended or adjusted under 35 U.S.C. 154(b) by 0 days.

(21) Appl. No.: 15/821,295

(22) Filed: Nov. 22, 2017

(65) Prior Publication Data

US 2018/0181152 A1 Jun. 28, 2018

(30) Foreign Application Priority Data

Dec. 28, 2016 (CN) ..... 2016 1 1230935

(51) Int. Cl.
*G05F 1/565* (2006.01)
*G05F 1/595* (2006.01)
*G05F 1/618* (2006.01)

(52) U.S. Cl.
CPC ..... *G05F 1/565* (2013.01); *G05F 1/595* (2013.01); *G05F 1/618* (2013.01)

(58) Field of Classification Search
CPC ..... G05F 1/565; G05F 1/595; G05F 1/618
See application file for complete search history.

(56) References Cited

U.S. PATENT DOCUMENTS 5,631,598 A * 5/1997 Miranda ..... G05F 1/565 327/483
6,201,375 B1 * 3/2001 Larson ..... G05F 1/573 323/277
6,300,749 B1 * 10/2001 Castelli ..... G05F 1/575 323/273
9,912,294 B2 * 3/2018 Pulijala ..... H03F 1/02
2002/0014882 A1 * 2/2002 Hsu ..... G05F 1/618 323/274
2011/0121802 A1 * 5/2011 Zhu ..... G05F 1/575 323/281
2014/0117952 A1 * 5/2014 Li ..... G05F 1/565 323/271
2014/0266106 A1 * 9/2014 El-Nozahi ..... G05F 1/575 323/280

* cited by examiner

*Primary Examiner* — Kyle J Moody
(74) *Attorney, Agent, or Firm* — Brinks Gilson & Lione

(57) ABSTRACT

The present disclosure relates to semiconductors and low dropout regulator (LDO) circuits. A LDO circuit may include first and second adjustment pipes and first and second error amplifiers. When an output voltage outputted by the output end of the LDO circuit is smaller than a reference voltage, the first error amplifier controls the first adjustment pipe to be turned on, and the second error amplifier controls the second adjustment pipe to be turned off. Alternative, when the output voltage is greater than the reference voltage, the first error amplifier controls the first adjustment pipe to be turned off, and the second error amplifier controls the second adjustment pipe to be turned on.

10 Claims, 7 Drawing Sheets

LOW DROPOUT REGULATOR (LDO) CIRCUIT

RELATED APPLICATION

The present application claims priority to Chinese Patent Application No. 201611230935.4, filed Dec. 28, 2016, the entirety of which is hereby incorporated by reference.

BACKGROUND

Technical Field

The present disclosure relates to the technical field of semiconductors, and more particularly to a low dropout regulator (LDO) circuit.

Related Art

A low dropout regulator (Low Dropout Regulator, LDO) has advantages such as a simple structure, low cost, low power consumption, and small packaging volume. Therefore, LDO is widely applied in portable electronic devices.

FIG. 1 is a schematic structural diagram of an existing LDO circuit. As shown in FIG. 1, the LDO circuit includes an adjustment pipe MP, an error amplifier A1, and two sampling resisters R1 and R2. An input end of the error amplifier $A_1$ receives a sampling voltage, and another input end receives a reference voltage $V_{ref}$. When an output voltage $V_{out}$ is smaller than a set value, a difference value between the reference voltage and a sampling voltage is increased; and the error amplifier $A_1$ controls a voltage drop of the adjustment pipe MP to be decreased, so that the output voltage $V_{out}$ is increased. Alternatively, when the output voltage $V_{out}$ is greater than the set value, the difference value between the reference voltage and the sampling voltage is decreased; and the error amplifier $A_1$ controls the voltage drop of the adjustment pipe MP to be increased, so that the output voltage $V_{out}$ is decreased.

SUMMARY

An objective of the present disclosure is providing an LDO circuit which is capable of stabilizing an output voltage faster.

In one form of the present disclosure, an LDO circuit is provided, including: a first adjustment pipe connected between an input end of the LDO circuit and an output end of the LDO circuit; a second adjustment pipe connected between the output end of the LDO circuit and a ground; a first error amplifier, including a first input end and a second input end, where the first input end is connected to the output end of the LDO circuit, and the second input end is configured to receive a reference voltage; a second error amplifier, including a third input end and a fourth input end, where the third input end is connected to the output end of the LDO circuit, and the fourth input end is configured to receive the reference voltage. In the LDO circuit, when an output voltage output by the output end of the LDO circuit is smaller than the reference voltage, the first error amplifier is configured to control the first adjustment pipe to be turned on, and the second error amplifier is configured to control the second adjustment pipe to be turned off. Further, when the output voltage is greater than the reference voltage, the first error amplifier is configured to control the first adjustment pipe to be turned off, and the second error amplifier is configured to control the second adjustment pipe to be turned on.

In some implementations, the first adjustment pipe includes a PMOS transistor, and the second adjustment pipe includes a NMOS transistor; a source electrode of the PMOS transistor is connected to the input end of the LDO circuit, a drain electrode of the PMOS transistor is connected to the output end of the LDO circuit, and a gate electrode of the PMOS transistor is connected to an output end of the first error amplifier; and a source electrode of the NMOS transistor is connected to the ground, a drain electrode of the NMOS transistor is connected to the output end of the LDO circuit, and a gate electrode of the NMOS transistor is connected to an output end of the second error amplifier.

In some implementations, a length and a width of a trench of the PMOS transistor is substantially the same as a length and a width of a trench of the NMOS transistor.

In some implementations, the first input end is a non-inverting input end of the first error amplifier, and the third input end is a non-inverting input end of the second error amplifier.

In some implementations, the LDO circuit further includes: a load module connected between the output end of the LDO circuit and the ground.

In some implementations, the load module includes a load capacitor, an equivalent resistor of the load capacitor, and a bypass capacitor; one end of the equivalent resistor of the load capacitor is connected to the output end of the LDO circuit, and another end is connected to the ground using the load capacitor; and one end of the bypass capacitor is connected to the output end of the LDO circuit, and another end is connected to the ground.

In some implementations, the load module includes a load capacitor, an equivalent resistor of the load capacitor, and a load capacitor; one end of the equivalent resistor of the load capacitor is connected to the output end of the LDO circuit, and another end is connected to the ground by using the load capacitor; and one end of the load capacitor is connected to the output end of the LDO circuit, and another end is connected to the ground.

In some implementations, the load capacitor includes an MOS capacitor.

In some implementations, the LDO circuit further includes: a reference voltage generating module configured to generate the reference voltage.

In some implementations, the LDO circuit further includes: a bias circuit configured to provide bias currents for the first error amplifier and the second error amplifier.

Compared with conventional LDO circuits, in the LDO circuits provided by embodiments and implementations of the present disclosure, two sampling circuits are removed, and two loops are formed by using two adjustment pipes, respectively. In cases in which an output voltage is increased and decreased, one of the two loops is turned on so that the output voltage may stabilize at an expected value more quickly. In addition, the LDO circuits of embodiments and implementations of the present disclosure improves a loop gain, increases a linear adjustment rate, reduces noises, reduces a quiescent current, and improves stability.

In the following detailed descriptions of embodiments and implementations of the present disclosure with reference to the accompanying drawings, other characters, aspects, and advantages of the present disclosure become clear.

BRIEF DESCRIPTION OF THE DRAWINGS

The accompanying drawings form a part of the specification, describe embodiments and implementations of the present disclosure for illustration purposes, and are used to explain the principles of the present disclosure together with the specification. In the accompanying drawings.

DETAILED DESCRIPTION

Embodiments and implementations of the present disclosure are described in detail for illustration purposes with reference to the accompanying drawings. It should be noted that unless being described in detail, relative layouts, mathematical expressions, and numeric values of components and steps described in these embodiments should not be understood as a limitation to the scope of the present disclosure.

In addition, it should be understood that for ease of description, sizes of the parts shown in the accompanying drawings are not necessarily drawn according to an actual proportional relationship. For example, thicknesses or widths of some layers may be magnified with respect to other layers.

The following description about the embodiments for illustration purposes is only illustrative, and should not be used as any limitation on the present disclosure and applications or uses of the present disclosure in any sense.

Technologies, methods, and devices that are known by a person of ordinary skill in the related fields may not be discussed in detail. However, in cases in which the technologies, methods, and devices are applicable, the technologies, methods, and devices should be considered as a part of the description.

It should be noted that similar reference signs and letters represent similar items in the accompanying drawings. Therefore, once an item is defined or described in a figure, the item needs not to be further discussed in the description of the subsequent figures.

Figure 1:
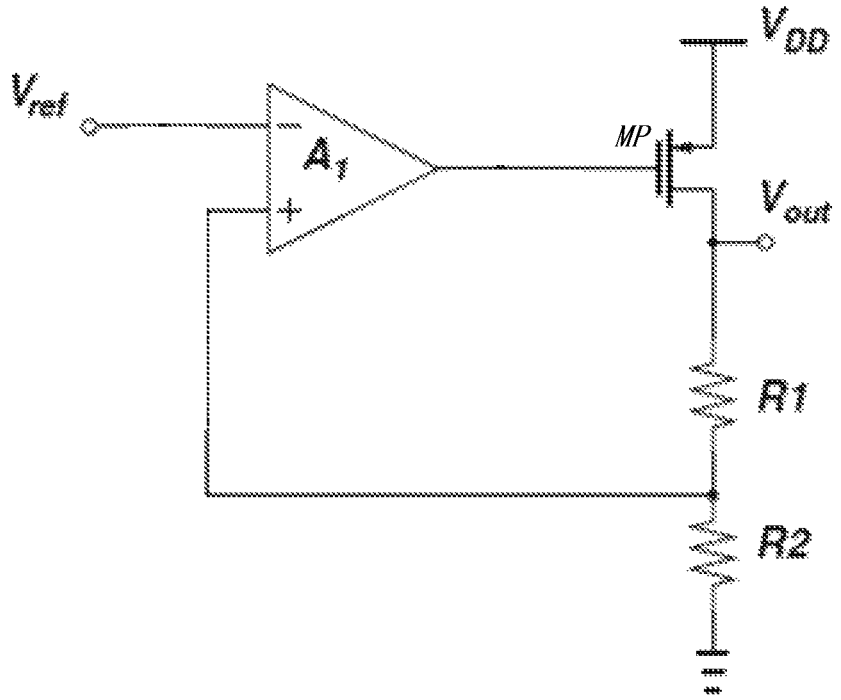
FIG. 1 is a schematic structural diagram of an existing LDO circuit.
Figure 2:
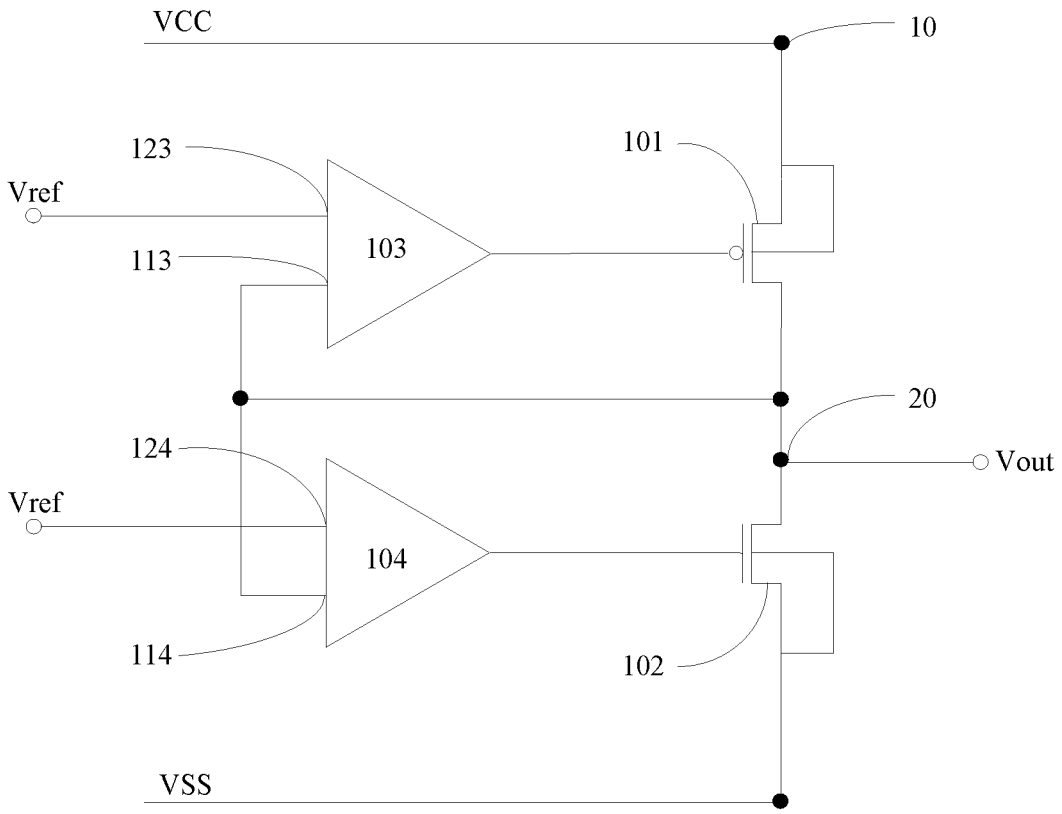
FIG. 2 is a schematic structural diagram of one form of an LDO circuit.

FIG. 2 is a schematic structural diagram of one form of an LDO circuit. As shown in FIG. 2, the LDO circuit includes a first adjustment pipe 101, a second adjustment pipe 102, a first error amplifier 103, and a second error amplifier 104.

The first adjustment pipe 101 is connected between an input end 10 of the LDO circuit and an output end 20 of the LDO circuit. The second adjustment pipe 102 is connected between the output end 20 of the LDO circuit and a ground VSS. As shown in FIG. 2, the first adjustment pipe 101 may be achieved by using a PMOS transistor, and the second adjustment pipe 102 may be achieved by using a NMOS transistor. Preferably, lengths and widths of trenches of the PMOS transistor and the NMOS transistor may be substantially the same. It should be noted that the "substantially the same" herein refers to be the same within a deviation range of semiconductor process.

In a case in which the first adjustment pipe 101 is the PMOS transistor, the second adjustment pipe 102 is the NMOS transistor, a source electrode of the PMOS transistor is connected to the input end 10 of the LDO circuit, a drain electrode of the PMOS transistor is connected to the output end 20 of the LDO circuit, and a gate electrode of the PMOS transistor is connected to an output end of the first error amplifier 103; and a source electrode of the NMOS transistor is connected to the ground VSS, a drain electrode of the NMOS transistor is connected to the output end 20 of the LDO circuit, and a gate electrode of the NMOS transistor is connected to an output end of the second error amplifier 104. However, it should be understood that the present disclosure is not limited hereto. In other embodiments and implementations, the first adjustment pipe 101 and the second adjustment pipe 102 may also be achieved using other types of power tubes (such as a bipolar transistor).

The first error amplifier 103 includes a first input end 113 and a second input end 123, where the first input end 113 is connected to the output end 20 of the LDO circuit, and the second input end 123 is used to receive the reference voltage Vref. The second error amplifier 104 includes a third input end 114 and a fourth input end 124, where the third input end 114 is connected to the output end 20 of the LDO circuit, and the fourth input end 124 is used to receive the reference voltage Vref. In some implementations, the first input end 113 is a non-inverting input end of the first error amplifier 103, and the second input end 123 is an inverting input end of the first error amplifier 103; and the third input end 114 is a non-inverting input end of the second error amplifier 104, and the fourth input end 124 is an inverting input end of the second error amplifier 104. In some implementations, the LDO circuit may further include a reference voltage generating module for generating the reference voltage Vref (not shown in the figure).

In a case in which an output voltage Vout outputted by the output end 20 of the LDO circuit is smaller than the reference voltage Vref, the first error amplifier 103 controls the first adjustment pipe 101 to be turned on, and the second error amplifier 104 controls the second adjustment pipe 102 to be turned off. Therefore, a loop composed of the first adjustment pipe 101, the output end 20 of the LDO circuit, and the first error amplifier 103 is turned on, so that the output voltage Vout is increased. In a case in which the output voltage Vout is greater than the reference voltage Vref, the first error amplifier 103 controls the first adjustment pipe 101 to be turned off, and the second error amplifier 104 controls the second adjustment pipe 102 to be turned on. Therefore, a loop composed of the second adjustment pipe 102, the output end 20 of the LDO circuit, and the second error amplifier 104 is turned on, so that the output voltage Vout is decreased. In this way, the output voltage Vout may be stabilized at a value around the reference voltage Vref.

Compared with conventional LDO circuits, in the LDO circuit provided by this implementation, two sampling circuits are removed, and two loops are formed by using two adjustment pipes, respectively. In cases in which an output voltage is increased and decreased, one of the two loops is turned on, so that the output voltage may be stabilized at an expected value more quickly.

Figure 3:
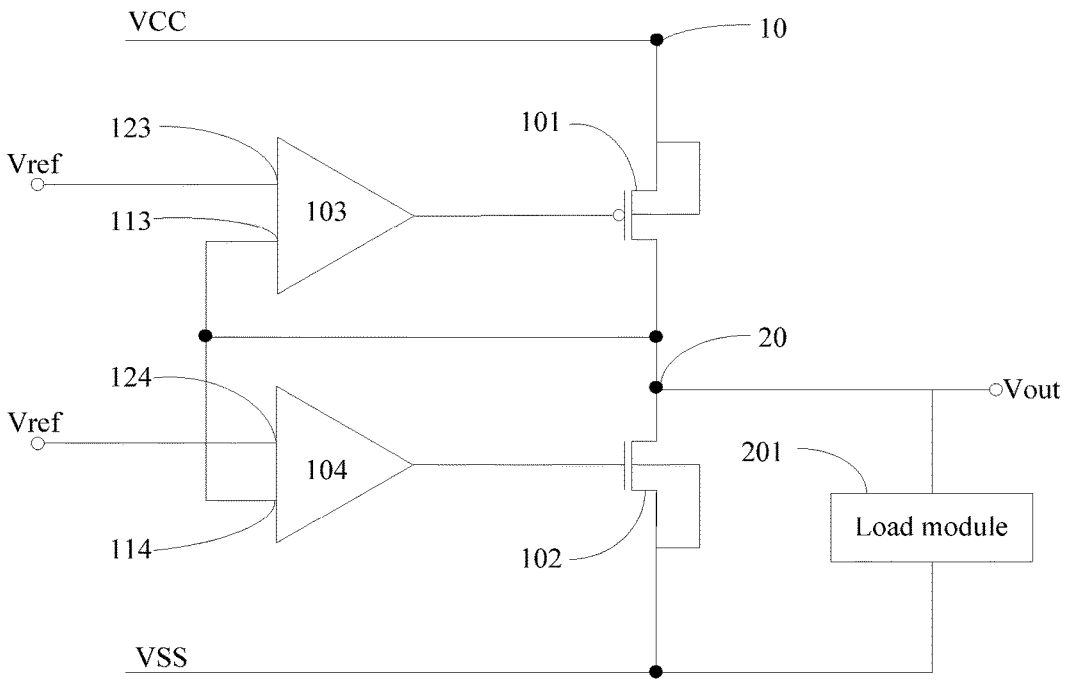
FIG. 3 is a schematic structural diagram of another form of an LDO.

FIG. 3 is a schematic structural diagram of another form an LDO circuit. As shown in FIG. 3, compared with the implementation shown in FIG. 2, the LDO circuit of this form may further include a load module 201 which is connected between the output end 20 of the LDO circuit and the ground VSS. The load module 201 may ensure the stability and good transient response of the output voltage of the LDO circuit, and may further have the functions of decoupling and filtering.

Figure 4:
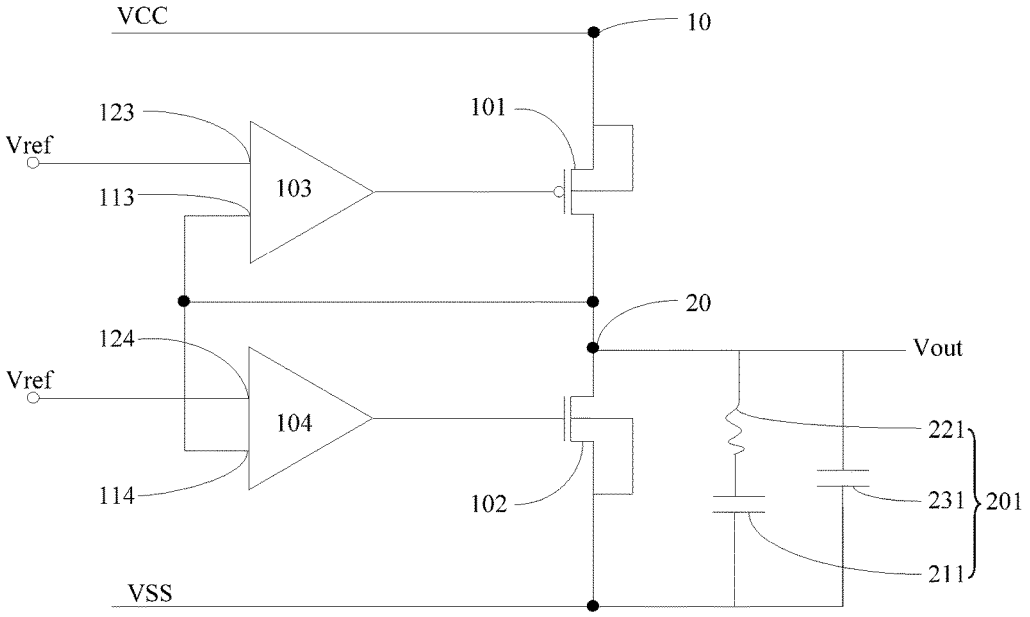
FIG. 4 is a schematic structural diagram of yet another form of an LDO circuit.

As a specific implementation manner of the load module 201, as shown in FIG. 4, the load module 201 may include a load capacitor 211, an equivalent resistor 221 of the load capacitor, and a bypass capacitor 231. One end of the equivalent resistor 221 of the load capacitor is connected to the output end 20 of the LDO circuit, and another end is connected to the ground VSS by using the load capacitor 211. One end of the bypass capacitor 231 is connected to the output end 20 of the LDO circuit, and another end is connected to the ground VSS. The load capacitor 211 and the bypass capacitor 231 may be MOM (metal-oxide-metal) capacitors or MOS (metal-oxide-semiconductor) capacitors. Preferably, the load capacitor 211 may be a MOS capacitor.

Figure 5:
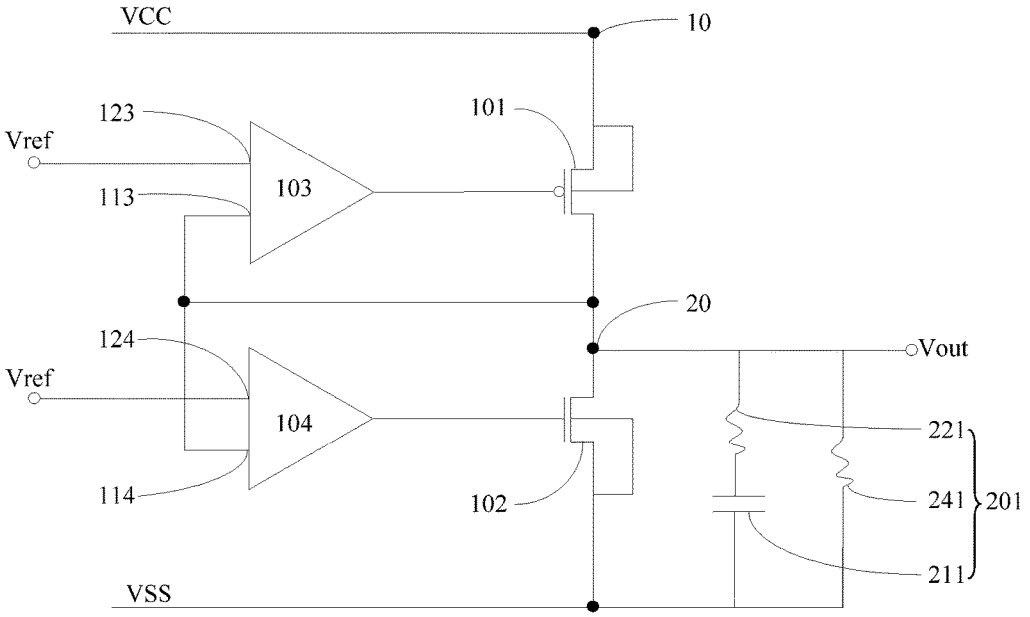
FIG. 5 is a schematic structural diagram of a further form of an LDO circuit.

In a specific implementation of the load module 201, as shown in FIG. 5, the load module 201 may include a load capacitor 211, an equivalent resistor 221 of the load capacitor, and a load resistor 241. One end of the equivalent resistor 221 of the load capacitor is connected to the output end 20 of the LDO circuit, and another end is connected to the ground VSS by using the load capacitor 211. One end of the load capacitor 241 is connected to the output end 20 of the LDO circuit, and another end is connected to the ground VSS.

Figure 6:
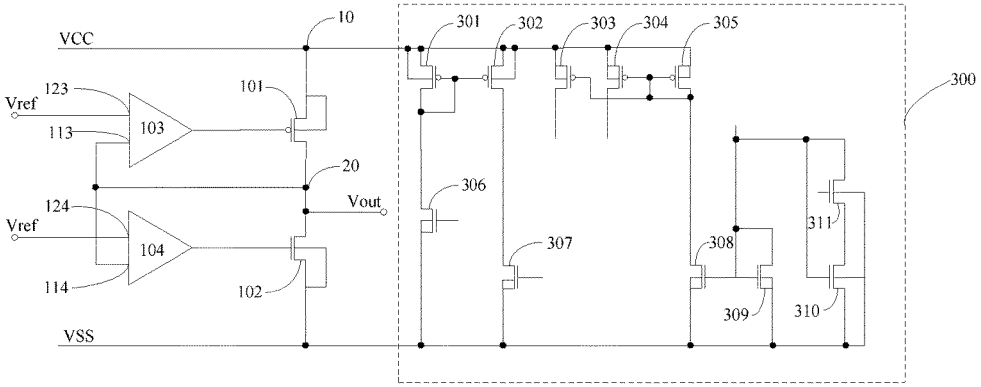
FIG. 6 is a schematic structural diagram of another form of an LDO circuit.

FIG. 6 is a schematic structural diagram of another form of an LDO circuit. As shown in FIG. 6, the LDO circuit may further include a bias circuit 300 for providing bias currents for the first error amplifier 103 and the second error amplifier 104.

In some implementations, as shown in FIG. 6, the bias circuit 300 may include a first PMOS transistor 301, a second PMOS transistor 302, a third PMOS transistor 303, a fourth PMOS transistor 304, a fifth PMOS transistor 305, a first NMOS transistor 306, a second NMOS transistor 307, a third NMOS transistor 308, a fourth NMOS transistor 309, a fifth NMOS transistor 310, and a sixth NMOS transistor 311.

Source electrodes of the first PMOS transistor 301, the second PMOS transistor 302, the third PMOS transistor 303, the fourth PMOS transistor 304, and the fifth PMOS transistor 305 are all connected to the input end 10 of the LDO circuit. A gate electrode of the first PMOS transistor 301 is connected to a gate electrode of the second PMOS transistor 302 and a drain electrode of the first NMOS transistor 306. Gate electrodes of the PMOS transistor 303, the fourth PMOS transistor 304, and the fifth PMOS transistor 305 are interconnected. A drain electrode of the first PMOS transistor 301 is connected to a drain electrode of the first NMOS transistor 306. A drain electrode of the second PMOS transistor 302 is connected to a drain electrode of the second NMOS transistor 307. A drain electrode of the third PMOS transistor 303 serves as an output end of the bias circuit. A drain electrode of the fourth PMOS transistor 304 is floated. A drain electrode of the fifth PMOS transistor 305 is connected to a drain electrode of the third NMOS transistor 308.

Source electrodes of the first NMOS transistor 306, the second NMOS transistor 307, the third NMOS transistor 308, the fourth NMOS transistor 309, and the fifth NMOS transistor 310 are all connected to the ground VSS. A source electrode of the sixth NMOS transistor 311 is connected to a drain electrode of the fifth NMOS transistor 310. Gate electrodes of the first NMOS transistor 306, the second NMOS transistor 307, the third NMOS transistor 308, the fourth NMOS transistor 309, and the fifth NMOS transistor 310 are all connected to a current source (not shown in the figure). Moreover, a gate electrode of the third NMOS transistor 308 is connected to a gate electrode of the fourth NMOS transistor 309. A gate electrode of the sixth NMOS transistor 311 is kept to be turned on because of being controlled by a gate voltage. Drain electrodes of the fourth NMOS transistor 309 and the sixth NMOS transistor 311 are connected to the current source (not shown in the figure).

In addition, substrates of the first PMOS transistor 301, the second PMOS transistor 302, the third PMOS transistor 303, the fourth PMOS transistor 304, and the fifth PMOS transistor 305 may all be connected to the input end 10 of the LDO circuit; and substrates of the first NMOS transistor 306, the second NMOS transistor 307, the third NMOS transistor 308, the fourth NMOS transistor 309, the fifth NMOS transistor 310, and the sixth NMOS transistor 311 may all be connected to the ground VSS. In actual applications, current outputted by the output end of the bias circuit may be controlled by adjusting the size of the foregoing current source, thereby providing proper bias currents for the first error amplifier and the second error amplifier.

Figure 7:
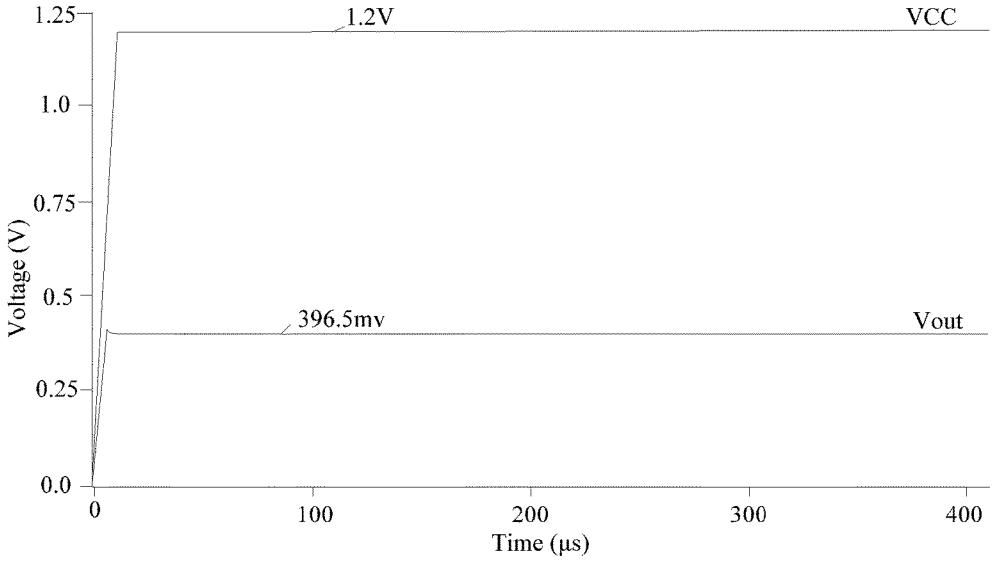
FIG. 7 shows a schematic simulation diagram of an input voltage and an output voltage of an LDO circuit that change with time.

FIG. 7 shows a schematic simulation diagram of an input voltage and an output voltage of an LDO circuit that changes with time. In this example, the reference voltage Vref is 0.4V. As shown in FIG. 7, an input voltage VCC is increased from 0 V to 1.2 V within about 10 μs, and an output voltage Vout is basically stabilized at a value around 0.4V. There is no oscillation, and the output voltage is stable.

Figure 8:
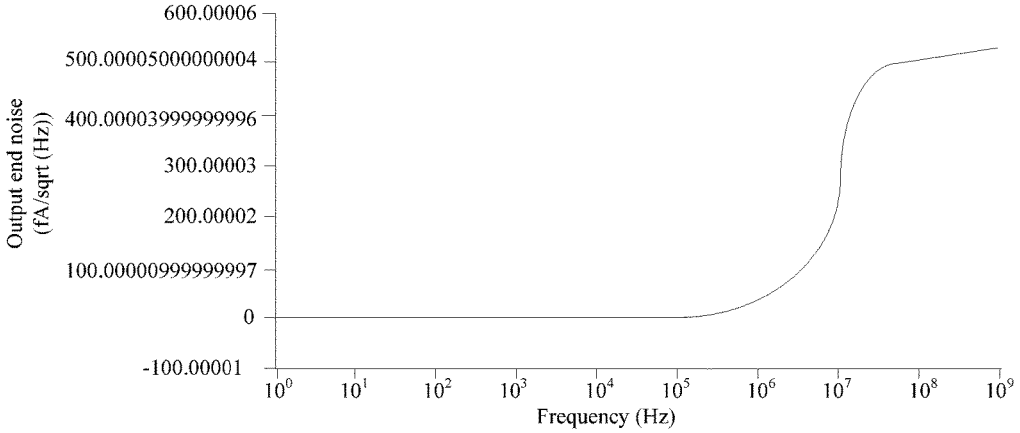
FIG. 8 shows a schematic simulation diagram of noise at an output end of an LDO circuit that changes with frequencies.

FIG. 8 shows a schematic simulation diagram of noise at an output end of an LDO circuit that changes with frequencies. As shown in FIG. 8, when a frequency is 10 MHz, output end noise is 10 fA/sqrt (Hz). Hence, output noise of the LDO circuit is small, and requirements for stability are satisfied.

Figure 9:
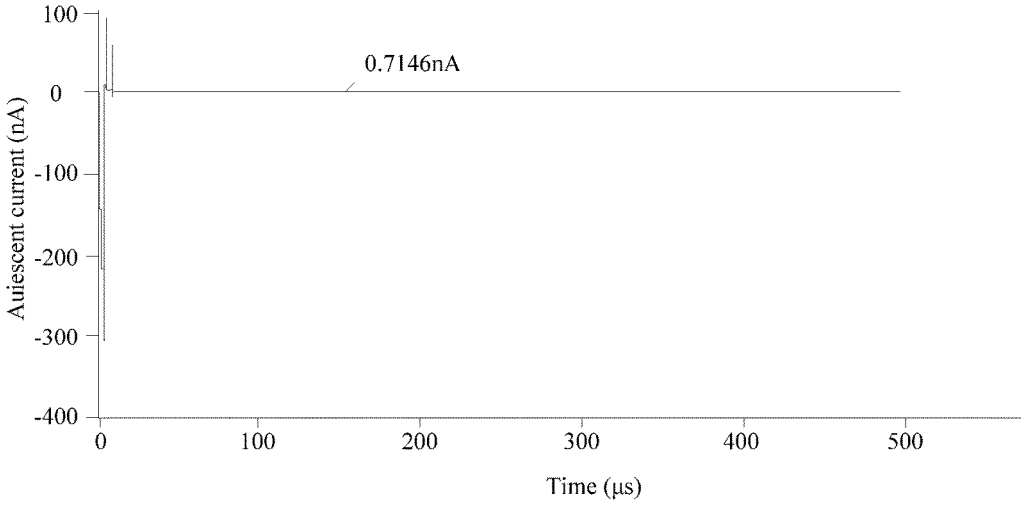
FIG. 9 shows a schematic simulation diagram of a quiescent current of an LDO circuit that changes with time.

FIG. 9 shows a schematic simulation diagram of a quiescent current of an LDO circuit that changes with time according. As shown in FIG. 9, a quiescent current is much smaller, and a value thereof is about 0.7146 nA, satisfying requirements for stability.

Figure 10:
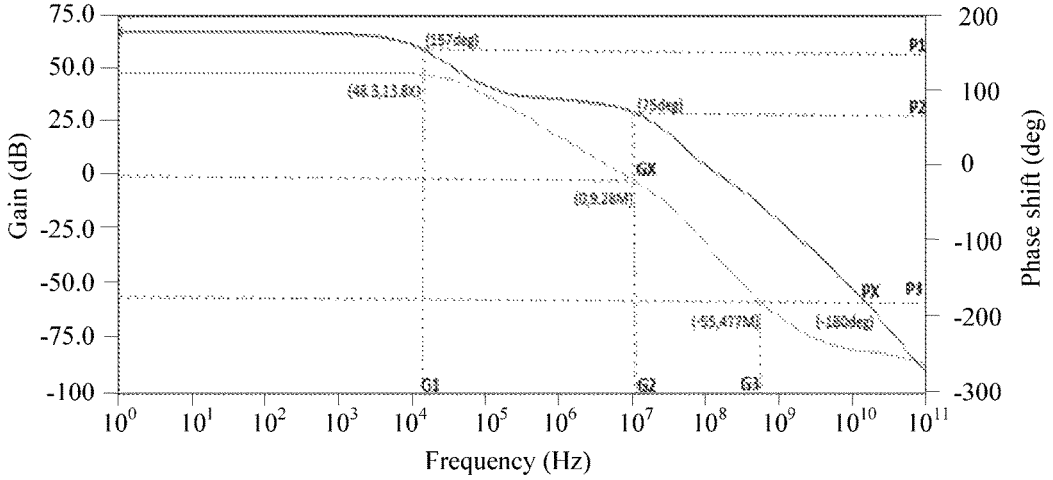
FIG. 10 shows a schematic simulation diagram of a loop gain and a phase shift of an LDO circuit that change with frequencies.

FIG. 10 shows a schematic simulation diagram of a loop gain and a phase shift of an LDO circuit that changes with frequency. As shown in FIG. 10, a loop gain of the LDO circuit of the embodiments of the present invention is about 50 db/dec, and a phase margin is about 255 deg. However, a loop gain of a traditional LDO circuit is smaller than 40 db/dec (for example, being 20 db/dec), and a phase margin is 120 deg. Therefore, the LDO circuit of the embodiments of the present invention has better stability.

Therefore, the LDO circuit of the embodiments of the present invention has the following beneficial effects: improving a loop gain, increasing a linear adjustment rate, reducing noises, reducing a quiescent current, and improving stability.

Above, the LDO circuit according to the embodiments of the present invention is described in detail. To avoid covering the idea of the present invention, some details generally known in the art are not described. According to the foregoing description, a person skilled in the art may completely understand how to implement the technical solutions disclosed herein. In addition, the embodiments according to the teaching disclosed in the specification may be freely combined. A person skilled in the art should understand that amendments can be made to the embodiments described above without departing from the scope and the spirit of the present invention that are defined by the appended claims.

What is claimed is:

1. A low dropout regulator (LDO) circuit, comprising:

a first adjustment pipe connected between an input end of the LDO circuit and an output end of the LDO circuit;

a second adjustment pipe connected between the output end of the LDO circuit and a ground;

a first error amplifier, comprising a first input end and a second input end, wherein the first input end is connected to the output end of the LDO circuit, and the second input end is configured to receive a reference voltage;

a second error amplifier, comprising a third input end and a fourth input end, wherein the third input end is connected to the output end of the LDO circuit, and the fourth input end is configured to receive the reference voltage;

wherein, when an output voltage output by the output end of the LDO circuit is smaller than the reference voltage, the first error amplifier is configured to control the first adjustment pipe to be turned on, and the second error amplifier is configured to control the second adjustment pipe to be turned off;

wherein, when the output voltage output by the output end of the LDO circuit is greater than the reference voltage, the first error amplifier is configured to control the first adjustment pipe to be turned off, and the second error amplifier is configured to control the second adjustment pipe to be turned on;

wherein the first adjustment pipe comprises a PMOS transistor, and the second adjustment pipe comprises a NMOS transistor; and wherein a length and a width of a trench of the PMOS transistor is substantially equal to a length and a width of a trench of the NMOS transistor.

2. The LDO circuit according to claim 1, wherein a source electrode of the PMOS transistor is connected to the input end of the LDO circuit, a drain electrode of the PMOS transistor is connected to the output end of the LDO circuit, and a gate electrode of the PMOS transistor is connected to an output end of the first error amplifier; and wherein a source electrode of the NMOS transistor is connected to the ground, a drain electrode of the NMOS transistor is connected to the output end of the LDO circuit, and a gate electrode of the NMOS transistor is connected to an output end of the second error amplifier.

3. The LDO circuit according to claim 1, wherein the first input end is a non-inverting input end of the first error amplifier, and the third input end is a non-inverting input end of the second error amplifier.

4. The LDO circuit according to claim 1, further comprising:

a load module connected between the output end of the LDO circuit and the ground.

5. The LDO circuit according to claim 4, wherein the load module comprises a load capacitor, an equivalent resistor of the load capacitor, and a bypass capacitor; one end of the equivalent resistor of the load capacitor is connected to the output end of the LDO circuit, and another end is connected to the ground by using the load capacitor; and wherein one end of the bypass capacitor is connected to the output end of the LDO circuit, and another end is connected to the ground.

6. The LDO circuit according to claim 5, wherein the load capacitor comprises an MOS capacitor.

7. The LDO circuit according to claim 4, wherein the load module comprises a load capacitor, an equivalent resistor of the load capacitor, and a load resistor;

wherein one end of the equivalent resistor of the load capacitor is connected to the output end of the LDO circuit, and another end is connected to the ground by using the load capacitor; and wherein one end of the load capacitor is connected to the output end of the LDO circuit, and another end is connected to the ground.

8. The LDO circuit according to claim 7, wherein the load capacitor comprises an MOS capacitor.

9. The LDO circuit according to claim 1, further comprising:

a reference voltage generating module configured to generate the reference voltage.

10. The LDO circuit according to claim 1, further comprising:

a bias circuit configured to provide bias currents for the first error amplifier and the second error amplifier.

* * * * *